United States Patent [19]

Van Malderghem et al.

[11] Patent Number: 4,705,298

[45] Date of Patent: Nov. 10, 1987

[54] DIE CUT WINDOW MAILER WITH SELF-IMAGING SHEET

[75] Inventors: Edmund G. Van Malderghem, Lewiston; Dominick L. Monico, Amherst; Michael W. Anderson, West Seneca, all of N.Y.

[73] Assignee: Moore Business Forms, Inc., Grand Island, N.Y.

[21] Appl. No.: 873,102

[22] Filed: Jun. 6, 1986

Related U.S. Application Data

[63] Continuation of Ser. No. 606,640, May 3, 1984, abandoned.

[51] Int. Cl.[4] ..... B41L 1/20; B41L 5/04; B65D 27/10; B65D 27/06

[52] U.S. Cl. ..... 282/11.5 A; 282/5; 229/69; 229/73

[58] Field of Search ..... 282/5, 11.5 A, 11.5 R, 282/12; 229/69, 72, 73, 83

[56] References Cited

U.S. PATENT DOCUMENTS

| | | | |
|---|---|---|---|
| 3,294,423 | 12/1966 | Mudd, Jr. | 282/11.5 R |
| 3,652,007 | 3/1972 | MacDougall | 229/69 |
| 3,837,565 | 9/1974 | Johnsen | 282/11.5 A |
| 4,230,262 | 10/1980 | Denay et al. | 282/11.5 A |
| 4,440,341 | 4/1984 | Pennock | 229/73 |
| 4,475,747 | 10/1984 | Ashby | 282/11.5 A |

*Primary Examiner*—Frank T. Yost
*Assistant Examiner*—Paul M. Heyrana, Sr.
*Attorney, Agent, or Firm*—Allegretti, Newitt, Witcoff & McAndrews, Ltd.

[57] ABSTRACT

A continuous business form assembly provides custom addressed, outgoing envelopes filled with contents sometimes including return envelopes. The assembly comprises at least four webs, one of which is a self-imaging web. The self-imaging web is positioned and adapted to provide custom addresses on itself visible through outgoing envelope windows.

3 Claims, 1 Drawing Figure

DIE CUT WINDOW MAILER WITH SELF-IMAGING SHEET

This is a continuation of application Ser. No. 606,640, filed May 3, 1984 and now abandoned.

BACKGROUND OF THE INVENTION

This invention relates to the art of continuous business form assemblies.

Continuous business form assemblies have been disclosed which provide custom addressed, outgoing envelopes filled with contents including return envelopes. Such assemblies include carbon imaging flysheets, which are positioned atop the outgoing envelope faces and impacted to provide the custom addresses. Such flysheets must be collated with the assemblies before printing and decollated after printing.

SUMMARY OF THE INVENTION

A principal object of the inventor in making the invention was to eliminate the flysheets from continuous business form assemblies providing custom addressed, outgoing envelopes.

Thus, in a principal aspect, the invention is a continuous business form assembly adapted to be processed through high speed forms handling machinery including an impact printer, and adapted to provide custom addressed, outgoing envelopes filled with contents including return envelopes. The assembly comprises at least four continuous and discontinuous webs. A first, or outgoing envelope face web is continuous and defines windows. A second, or self-imaging web is positioned behind the outgoing envelope face web and the windows. The self-imaging web is adapted to provide custom addresses on itself visible through the windows, when impacted with custom address information by an impact printer. Additional contents webs can be positioned behind the self-imaging web. An outgoing envelope back web is also positioned behind the self-imaging and other contents webs. The outgoing envelope face web and the outgoing envelope back web are adhered together to form a plurality of outgoing envelopes. Thus, the custom addressed, outgoing envelopes are provided, filled with contents without reliance upon a flysheet.

BRIEF DESCRIPTION OF THE DRAWING

The drawing of one FIGURE is a progressively cut away, plan view of the preferred form assembly of the invention.

DETAILED DESCRIPTION OF THE PREFERRED EMBODIMENT

Figure 1:
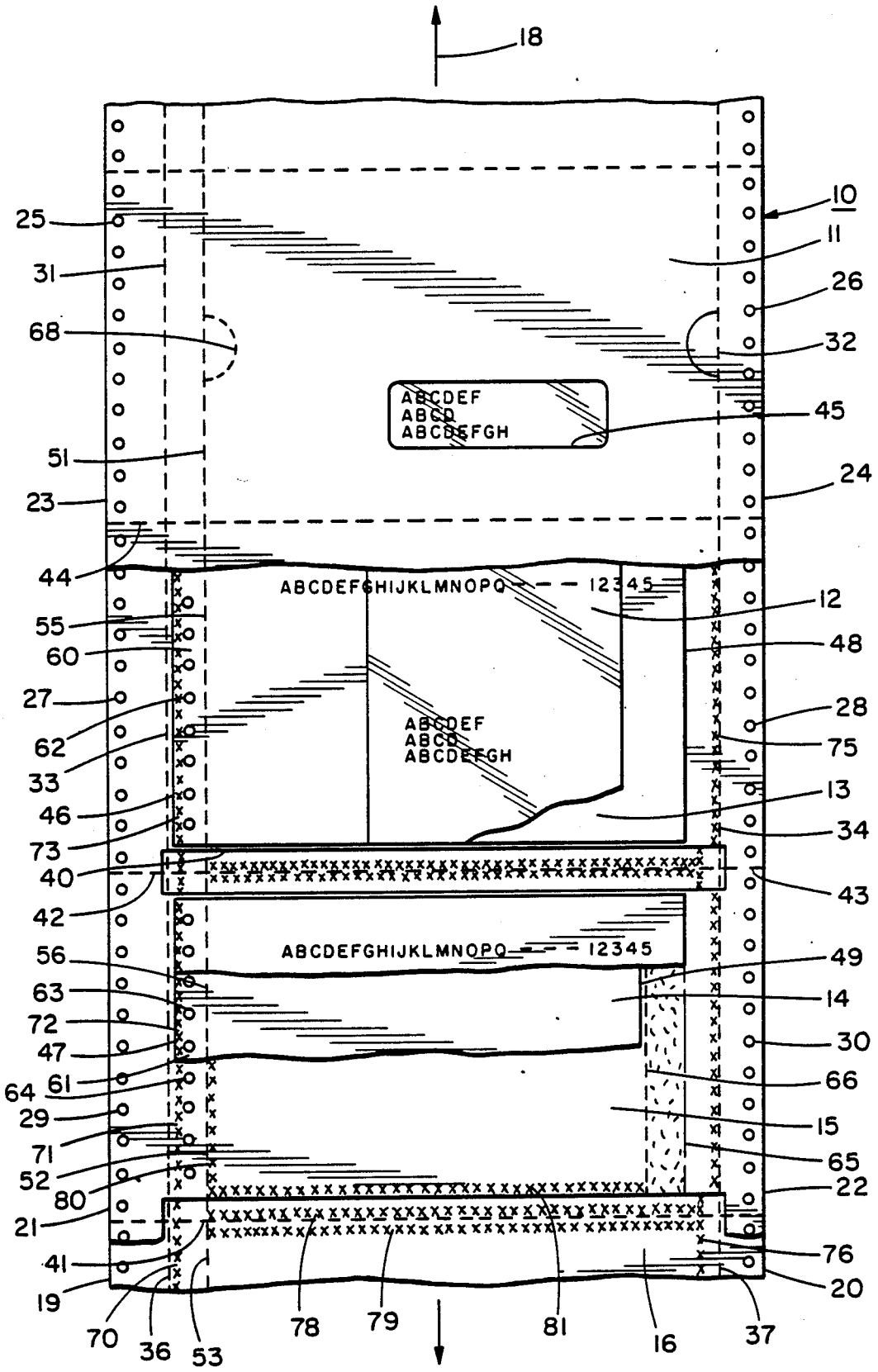

The preferred embodiment of the invention is considered to be illustrative and not restrictive, except to the extent features of the preferred embodiment are included as limitations in the claims.

Referring to FIG. 1, the preferred embodiment of the invention is a continuous business form assembly 10 comprising six webs 11–16. The assembly 10 defines a longitudinal direction along a longitudinal, central axis 18, and a transverse direction perpendicular to the axis. The webs 11, 12, 15 and 16 are longitudinally continuous. The webs 13, 14 are continuous when collated onto the web 15, and thereafter die cut with the web 15, to be discontinuous as shown.

The webs 11, 15, 16 have equal transverse widths. The web 16 has opposed, longitudinally extending marginal edges 19, 20. The web 15 has opposed, longitudinally extending marginal edges 21, 22 superimposed on the edges 19, 20, respectively. The web 11 has opposed, longitudinally extending marginal edges 23, 24 superimposed on the edges 21, 22, respectively.

Each web, 11, 15, 16 has longitudinally extending, spaced marginal pin feed holes along both marginal edges thereof. The web 11 has feed holes 25, 26; the web 15 has feed holes 27, 28; and the web 16 has feed holes 29, 30. The feed holes of the web 11 are superimposed over those of the web 15, and the feed holes of both webs 11, 15 are superimposed over the feed holes of the web 16, as follows: feed holes 25 over 27 over 29; and feed holes 26 over 28 over 30.

Marginal feed strips are defined on the webs 11, 15, 16 by longitudinally extending, marginal perforation lines thereon. Perforation lines 31, 32 on the web 11 are inward of, i.e., closer the central axis 18 than, the marginal edges 23, 24 and feed holes 25, 26. Perforation lines 33, 34 on the web 15 are inward of the edges 21, 22 and feed holes 27, 28. Perforation lines 36, 37 on the web 16 are inward of the edges 19, 20 and feed holes 29, 30. The perforation lines 31, 33 are superimposed on the lines 36. The perforation lines 32, 34 are superimposed on the lines 37. The perforation lines 33, 34 are discontinuous, being interrupted by a series of longitudinally spaced, transversely extending die cuts 40.

The die cuts 40 are rectangular, extend transversely across the web 15, and are longitudinally centered upon transversely extending perforation lines 41 of the web 16. The perforation lines 41 are in a series, longitudinally spaced. Superimposed upon marginal portions thereof are abbreviated, marginal perforation lines 42, 43 of the web 15. Superimposed upon the central portions of the lines 41 and upon the lines 42, 43 are transversely extending perforation lines 44 of the web 11. The marginal perforation lines 42, 43 of the web 15 extend between the die cuts 40 and the web edges 21, 22.

The webs 12, 13, 14 are transversely abbreviated, in comparison to the webs 11, 15, 16. The web 12 is longitudinally continuous, transversely narrow and centered behind die cut windows 45 defined in the web 11. The web 12 is adhered to the web 11 (not shown) about the periphery of the windows 45.

The webs 13, 14 are transversely wider than the web 12. The web 13 is wider than the web 14. The webs 13, 14 extend inward from superimposed side edges 46, 47 respectively, along the marginal perforation lines 31, 33, 36. The webs 13, 14 terminate transversely at opposite side edges 48, 49, respectively.

First, longitudinally extending, non-marginal perforation lines are formed on the webs 11, 15, 16 inward of the marginal perforation lines 31, 33, 36. A first non-marginal perforation line 51 of the web 11 is superimposed over a first non-marginal perforation line 52 of the web 15. Both lines 51, 52 are superimposed over, not on, a first non-marginal perforation line 53 of the web 16.

The webs 13, 14 have longitudinally extending perforation lines 55, 56, respectively, correspondng to the lines 51, 52, 53. The line 56 is superimposed over the line 52; the line 55 is superimposed over the line 56.

Between the lines 55, 56 and the edges 46, 47, the webs 13, 14 have longitudinally extending collating strips 60, 61, respectively, with longitudinally extending pin feed holes 62, 63, respectively. The feed holes 62 are superimposed on the holes 63. The strip 60 is superimposed on the strip 61. The web 15 has non-marginal pin feed holes 64 on which the feed holes 62, 63 are superimposed, for collation of the webs 13, 14 with the web 15.

The web 15 has second and third non-marginal perforation lines. A second, longitudinally extending, discontinuous, non-marginal perforation line 65 is inward of the marginal perforation line 34. A third, longitudinally extending, discontinuous, non-marginal fold perforation line 66 to aid in folding the flap over on the return envelope is inward of the second line 65. The edge 48 of the web 13 is along the second non-marginal perforation line 65. The edge 49 of the web 14 is slightly inward longitudinally of the line 66.

The webs 13, 14 extend in series of sheets spaced between the die cuts 40 of the web 15.

The webs 11–16 are adhered together to form the assembly 10. Continuous, longitudinally extending adhesive lines 70–73 between the marginal perforation lines 31, 33, 36 and the perforation lines 51, 52, 53, 55, 56 join all the webs 11–16. Continuous, longitudinally extending adhesive lines 75, 76 are located between the marginal perforation lines 32, 34, 37 and the second non-marginal perforation line 65. The adhesive lines 75, 76 join the webs 11, 15, 16. Pairs of transversely extending adhesive lines 78, 79 extend along the transverse perforation lines 41 in the areas of the die cuts 40, to join the webs 11, 16. Finally, a discontinuous, longitudinally extending adhesive line 80 and transversely extending perforation lines 81 join the webs 14, 15. The line 80 is inward of the perforation lines 52, 56. The lines 81 are along the die cuts 40, between the webs 14, 15.

As may now be apparent, the webs 11, 16 form a continuous series of outgoing envelopes. The web 11 forms the faces or face panels of such envelopes, while the web 16 forms the backs or back panels thereof. Each face panel is outlined by portions of the perforation lines 31, 32 and two adjacent transverse perforation lines 44. Each back panel is outlined by portions of the perforation lines 36, 37 and two adjacent perforation lines 41.

The continuous web 12 forms window patches for the die cut windows 45 of the face panel web 11 of the outgoing envelopes.

The webs 14, 15 form a continuous series of return envelopes within the outgoing envelopes. Each return envelope is outlined by portions of the longitudinal perforation lines 52, 56, portions of the longitudinal fold perforation line 66 and the edge 49, and adjacent pairs of transverse edges of the webs 14, 15 along the die cuts 40. A return envelope flap, having a moisture active adhesive or the like, is outlined by the perforation lines 65, 66 and edges along the die cut 40. The perforation line 65 is weaker than the line 66, to assure the flap is not mistakenly separated from the return envelope.

The web 13 is a self-imaging web positioned behind the face panels of the outgoing envelopes, and the windows thereof. The web 13 includes a coating of microcapsules of dye and dye developer. When impacted by an impact printer or the like, the web 13 provides images on itself visible through the windows 45.

The assembly 10 may be used as follows. First, such non-custom information as desired may be pre-printed on the outgoing and return envelope webs as well as the contents webs of the assembly 10. The webs 13, 14 are then collated with the web 15 by feed holes 62, 63, 64 and adhered thereto. The webs 11–16 are then all collated and adhered together, forming the outgoing and return envelopes. The assembly 10 is passed through an impact printer using a blank, uncoated ribbon or no ribbon. The web 13 is imaged with variable data and the custom address information appears through the window area 45. The outgoing envelopes are separated from each other, and the marginal strips removed. The outgoing envelopes are then sent to their destinations.

Upon receipt, the outgoing envelopes are burst transversely through the use of perforated thumb notches 68, to release the return envelopes and self-imaging sheets of the web 12 and other possible contents webs. The sheets 11, 16 are discarded, and the return envelopes, filled as desired, sealed and returned.

The foregoing detailed description describes the preferred embodiment of the invention. As should be understood, the preferred embodiment may be variously modified. As an example, an additional, longitudinally discontinuous web could be added between the webs 13, 14 to provide outgoing message sheets. Therefore, to particularly point out and distinctly claim the subject matter regarded as invention, the following claims conclude this specification.

What is regarded as invention and claimed is:

1. A continuous business form assembly adapted to be processed through high speed machinery including an impact printer, and to provide custom addressed, outgoing envelopes filled with contents including return envelopes, the assembly comprising:

a continuous outgoing envelope face web defining windows therein;

a self-imaging web positioned behind the outgoing envelope face web and the windows thereof adapted to provide custom addresses on itself visible through the windows when impacted with custom address information by an impact printer;

a return envelope face web positioned behind the self-imaging web;

a return envelope back web behind the self-imaging web; and a continuous outgoing envelope back web positioned behind the self-imaging web;

the outgoing envelope face web, the return envelope back web and the outgoing envelope back web having equal transverse widths;

the outgoing envelope face web having marginal edges and having longitudinally extending, spaced marginal pin feed holes along the marginal edges;

the return envelope back web having marginal edges and having longitudinally extending, spaced marginal pin feed holes along the marginal edges;

the outgoing envelope back web having marginal edges and having longitudinally extending, spaced marginal pin feed holes along the marginal edges;

the pin feed holes of the outgoing envelope face web being superimposed over the pin feed holes of the return envelope back web;

the pin feed holes of the return envelope back web being superimposed over the pin feed holes of the outgoing evelope back web;

the outgoing envelope face web and the outgoing envelope back web adhered together to form a plurality of outgoing envelopes;

the return envelope face web and the return envelope back web having feed strips and being carrier webs for the assembly and being adhered together to form a plurality of return envelopes within the outgoing envelopes;

whereby the custom addressed, outgoing envelopes filled with contents including return envelopes are provided, without reliance upon a flysheet.

2. A continuous business form assembly as in claim 1 in which the assembly further comprises:

the outgoing envelope face web having longitudinally extending, marginal perforation lines inward of the outgoing envelope face web marginal edges;

the return envelope back web having longitudinally extending, marginal perforation lines inward of the return envelope back web marginal edges;

the outgoing envelope back web having marginal perforation lines inward of the outgoing envelope back web marginal edges;

the perforation lines of the outgoing envelope face web being superimposed over the perforation lines of the return envelope back web;

the perforation lines of the return envelope back web being superimposed over the perforation lines of the outgoing envelope back web;

the perforation lines of the return envelope back web being discontinuous;

rectangular die cuts extending transversely across the return envelope back web;

a transversely extending web terminus perforation line;

the die cuts being longitudinally centered on the web terminus perforation line;

the web terminus perforation line having marginal portions and central portions;

the return envelope back web having marginal perforation lines superimposed on the marginal portions of the web terminus perforation line;

the continuous outgoing envelope face web having tranversely extending perforation lines superimposed on the central portion of the web terminus perforation line and on the abbreviated marginal perforation lines;

the marginal perforation lines of the return envelope back web extending between the die cuts and the marginal edges of the return envelope back web.

3. A continuous business form assembly as in claim 2 wherein the self-imaging web is longitudinally continuous, transversely narrow and centered behind the outgoing envelope face web windows.

* * * * *